United States Patent [19]

Suzuki et al.

[11] Patent Number: 4,719,077

[45] Date of Patent: Jan. 12, 1988

[54] METHOD FOR THE PREPARATION OF AN ALLOY OF NICKEL AND TITANIUM

[75] Inventors: Yoshikazu Suzuki; Hidero Unuma, both of Sapporo, Japan

[73] Assignee: Agency of Industrial Science and Technology, Tokyo, Japan

[21] Appl. No.: 59,811

[22] Filed: Jun. 9, 1987

[30] Foreign Application Priority Data

Jun. 12, 1986 [JP] Japan ..... 61-137950

[51] Int. Cl.[4] ..... B22F 1/00

[52] U.S. Cl. ..... 419/23; 75/246; 419/31; 419/38; 419/39; 419/46; 419/53; 419/54

[58] Field of Search ..... 419/23, 31, 38, 39, 419/46, 53, 54; 75/246

[56] References Cited

U.S. PATENT DOCUMENTS 3,950,166 4/1976 Obara et al. ..... 419/46

4,478,790 10/1984 Huther et al. ..... 419/53

4,657,822 4/1987 Goldstein ..... 75/246

*Primary Examiner*—Stephen J. Lechert, Jr.

*Attorney, Agent, or Firm*—Hopgood, Calimafde, Kalil, Blaustein & Judlowe

[57] ABSTRACT

An alloy of nickel and titanium in the atomic ratio of 49:51 to 56:44 can be prepared at a temperature much lower than the eutectic point of the corresponding alloy. Thus, a green compact of a powdery mixture of the component metals is subjected to a heat treatment under high vacuum first at a rate of temperature elevation of 5° to 30° C./minute up to a temperature of, for example, 600° C. and then at a rate of temperature elevation of at least 40° C./minute up to a temperature of 815°-900° C. The surface of the metal particles is activated at the first stage along with degassing and the surface-activated metal particles are brought into an exothermic reaction at the second stage to cause explosive fusion and alloying.

4 Claims, 1 Drawing Figure

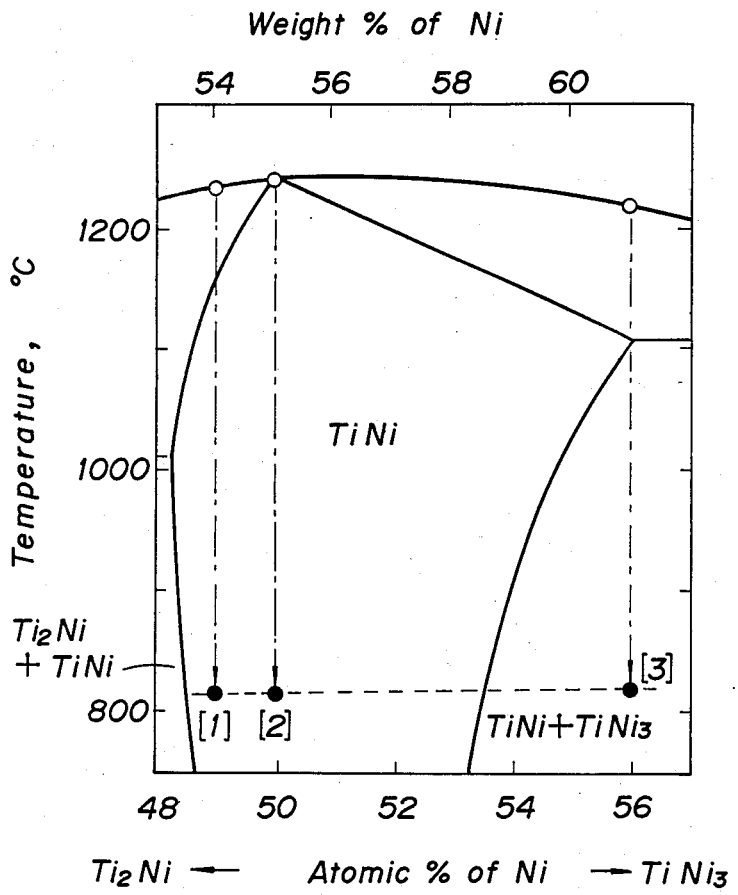
Weight % of Ni
54
56
58
60
1200
1000
800
Temperature, °C
TiNi
Ti2Ni
+ TiNi
[1]
[2]
[3]
TiNi+TiNi3
48
50
52
54
56
Ti2Ni
Atomic % of Ni
TiNi3

METHOD FOR THE PREPARATION OF AN ALLOY OF NICKEL AND TITANIUM

BACKGROUND OF THE INVENTION

The present invention relates to a method for the preparation of an alloy of nickel and titanium or, more particularly, to a method for the preparation of an alloy of nickel and titanium from powders of the respective metals by heating only at a temperature much lower than the eutectic point of an alloy with the same proportion of the two metals.

As is known, alloys of nickel and titanium are important corrosion-resistant materials and widely used in many applications. In addition thereto, a novel application has been developed in recent years for the alloys of nickel and titanium as a shape-memory alloy highlighted in the modern technology with rapidly increasing demand for the alloys.

Generally speaking, alloys of two kinds or more of different metals are prepared by the method of fusion in which the respective metals are melted by heating at a temperature higher than the melting point of the metal and the molten metals are uniformly mixed together or, alternatively, by the method of diffusion in which solid metals are kept in intimate contact at a temperature somewhat lower than the melting point for a sufficiently long time so that the atoms of the different metals diffuse each into the other to form an alloy.

When an alloy of nickel and titanium is to be prepared by the conventional fusion method, for example, the respective metals must be melted by heating at a temperature of 1500° C. or higher and kept at the temperature for a long time. When the diffusion method is undertaken for the preparation of an alloy of nickel and titanium, the blend compact of the metal powders must be sintered at 1000° C. or higher for a length of time still longer than in the fusion method. The alloying procedure at such high temperatures is unavoidably accompanied by a problem that the alloy is more or less contaminated by the oxides and carbides so that the purity of the alloy is usually not high enough unless the alloying procedure is undertaken under utmost care with great troublesomeness in addition to the expensiveness of the apparatus used in carrying out the high-temperature process. The process temperature can be decreased by increasing the proportion of nickel in the alloy to decrease the transformation point. The application field of such a high-nickel alloy, however, is limited due to the increase in the hardness of the alloy to cause difficulties in working or, in particular, in the fabrication of springs from a wire of a large diameter.

SUMMARY OF THE INVENTION

The present invention has an object to provide a novel method for the preparation of an alloy of nickel and titanium containing a greatly decreased amount of impurities by dissolving the above described problems and disadvantages in the prior art method of alloying, according to which the alloy can be formed at a much lower temperature of heating than in the prior art methods and the alloy can be shaped into a desired form easily in the course of the alloying procedure.

Thus, the method of the present invention for the preparation of an alloy of nickel and titanium, in particular, in an atomic ratio in the range from 49:51 to 56:44 comprises the successive steps of:

(a) mixing powders of nickel and titanium each having a limited particle size distribution in an atomic ratio in the range from 49:51 to 56:44 to give a powdery mixture;

(b) shaping the powdery mixture by compression molding into a green compact;

(c) heating the green compact in an atmosphere of vacuum under a pressure not exceeding $1\times10^{-5}$ torr at a rate of temperature elevation in the range from 5° to 30° C. per minute from about 200° C. up to a temperature in the range from 580° to 650° C.; and (d) heating the green compact after the step (c) in an atmosphere of vacuum under a pressure not exceeding $1\times10^{-5}$ torr at a rate of temperature elevation of at least 40° C. per minute from a temperature in the range from 580° to 650° C. up to a temperature in the range from 815° to 900° C.

BRIEF DESCRIPTION OF THE DRAWING

The figure is a phase diagram of the nickel-titanium alloy system.

DETAILED DESCRIPTION OF THE PREFERRED EMBODIMENTS

As is well known, gases in the atmospheric air are usually adsorbed on the surface of particles of metal powders to form a thin layer of a metal compound covering the surface. When a metal powder is heated under high vacuum, it is generally accepted that gases are evolved from the metal powder by the desorption of the adsorbed gases and decomposition of the metal compound forming the surface layer to leave activated surfaces of the metal particles.

In the method of the present invention, a green compact shaped by molding a uniform powdery mixture of nickel and titanium is heated under high vacuum first at a relatively small rate of temperature elevation up to a certain temperature so that the surface of the metal particles are activated according to the above mentioned mechanism with gas evolution. Thereafter, heating of the green compact is further continued at an increased rate of temperature elevation so that a reaction takes place explosively between the metal particles having activated surfaces to cause fusion and alloying of the component metals even at a temperature much lower than the corresponding eutectic point of the alloy.

The starting materials used in the inventive method are powders of nickel and titanium. The powders should preferably have an average particle diameter as small as possible in order that the reaction between the surface-activated metal particles proceeds to such an extent that the component metals can be successfully brought into fusion and alloyed. In particular, the nickel powder should preferably have an average particle diameter not exceeding 2.2 μm and the titanium powder should preferably have an average particle diameter not exceeding 55 μm. When the metal powders having a coarser particle size distribution are used, the metal powders in the green compact may sometimes fail to go into successful fusion and alloying due to the deficiency in the surface area of the metal particles to be activated and pertain to the alloying reaction. Though not particularly limitative, the inventive method gives a satisfactory result when the mixing ratio of the powders of nickel and titanium is in the range from 49:51 to 56:44 in the atomic ratio. When the mixing ratio of the metal powders is outside the above mentioned range, the green compact of the powdery mixture may sometimes fail to be brought into fusion and alloying due to the deficiency in the amount of heat evolved by the exothermic reaction. The respective metal powders are taken in such a proportion and mixed together to give a uniform powdery blend which is shaped by compression molding into a green compact of a desired form. These procedures are conventional and need not be described in further detail.

The green compact of the powdery mixture is then subjected to a heat treatment under high vacuum at a controlled rate of temperature elevation. Namely, the pressure of the vacuum atmosphere should preferably be $1\times10^{-5}$ torr or below. The heat treatment is performed with a schedule of temperature elevation divided in two stages, of which the first stage is for the activation of the surfaces of the metal particles and the second stage is for the alloying reaction between the surface-activated particles of nickel and titanium.

In the first stage of the heat treatment for the surface activation of metal particles, the rate of temperature elevation should be relatively small in the range from 5° to 30° C. per minute. When the green compact is heated at such a rate of temperature elevation, it is usual that gases are emitted from the green compact in two steps. In the first place, gas evolution takes place when the increasing temperature has reached about 350° C. The gas evolution at this stage is presumably due to the desorption of the gases physically adsorbed on the surface of the metal particles. When heating of the green compact is further continued also at the above mentioned rate of temperature elevation, a second gas evolution begins when the temperature has reached about 600° C. presumably due to the decomposition of the metal compounds forming the surface layer of the metal particles. The surfaces of the metal particles are now in an activated condition when the gas evolution in this second stage has started. The above mentioned rate of temperature elevation in the first stage must be maintained in the temperature range from about 200° C. to a temperature of 580° to 650° C. The rate of temperature elevation before the increasing temperature reaches about 200° C. is not particularly limitative and should be appropriately selected in consideration of the apparatus conditions and productivity of the process. When the increasing temperature has reached 580° to 650° C., the schedule of temperature elevation should now enter the second stage as mentioned below.

The second stage of the heat treatment in the inventive method is started when the second gas evolution from the green compact takes place. The second stage of the heat treatment is characterized by the relatively large rate of temperature elevation which should be at least 40° C. per minute. Thus, the power input to the electric furnace should be increased so that the temperature of the green compact can be increased at such an increased rate of temperature elevation. Alternatively, the green compact may be moved toward a zone inside the furnace at a higher temperature so that the temperature of the green compact is rapidly increased.

When the temperature of the green compact has reached about 815° to 900° C. by further increasing the temperature, an exothermic reaction occurs with a large volume of gas evolution to cause explosive fusion and alloying of the component metals to give a desired alloy of nickel and titanium. It is preferable in order to have increased uniformity in the alloy composition of the thus alloyed body that the alloyed body is aged by keeping at a temperature in the range from 830° to 900° C. for a length of time between 10 minutes and 2 hours.

Since the powdery mixture of nickel and titanium is shaped by compression molding into a compact, the gas evolution from the compact necessary for the exothermic reaction can be adequately controlled to continue at a sustained rate until the temperature of the green compact reaches a temperature sufficiently high for alloying. When the rate of temperature elevation is smaller than 40° C. per minute after the gas evolution at about 600° C., the exothermic reaction does not proceed at a sufficiently high velocity even when the temperature of the green compact has reached about 815° C. so that the desired alloy of nickel and titanium cannot be obtained.

As is understood from the above given description, the inventive method provides a menas for obtaining an alloy of nickel and titnaium even at a temperature lower than the eutectic point of the corresponding alloy by several hundreds °C. While the eutectic point of an alloy of 50 atomic % of nickel and 50 atomic % of titanium is 1240° C., which is much lower than the melting points 1455° C. and 1675° C. of nickel and titanium, respectively, the same alloy can be prepared according to the inventive method at a temperature of about 815° C. by the fusion and alloying of the component metals.

The above mentioned great decrease in the alloying temperature is very advantageous in comparison with the prior art methods not only in respect of the decreased costs for the thermal energy but also in respect of the decreased contamination of the resultant alloy by the impurities such as oxides and carbides formed at high temperatures.

An additional advantage is obtained, moreover, by practicing the method of the present invention that the alloy can be shaped into a desired form easily in the course of alloying. While it is a practice in the conventional method to use a very expensive apparatus of hot press in order to obtain a sintered body having a sufficiently high density, no such an expensive apparatus is required in the present invention. For example, the green compact shaped from the powdery mixture of nickel and titanium is put in a carbon-made mold of a desired form and subjected to the heat treatment at a relatively low temperature in the above described manner so that an alloyed body of the desired form can be obtained in the carbon mold. Advantageously, the carbonaceous material of the mold is dissolved very little into the alloy so that the alloy is free from the problem of contamination by carbon. Furthermore, the alloy is never heated at an unduly high temperature throughout and after the alloying procedure so that the alloy is free from the undesirable grain growth retaining the fine crystallite structure and would have excellent mechanical properties by virtue of the improved metallographic structure. Accordingly, the alloy of nickel and titanium prepared by the inventive method can be used advantageously, for example, as a shape-memory alloy and in other applications.

In the following, the method of the present invention is described in more detail by way of an example and comparative example.

EXAMPLE

Three powdery mixtures were prepared by uniformly blending powders of nickel and titanium in atomic ratios of 49:51, 50:50 and 56:44. The powders of nickel and titanium had average particle diameters of 2.2 μm and 55 μm, respectively. Each of the powdery mixtures was shaped by compression molding under a pressure of 3 tons/cm$^2$ into green compacts of a pellet-like form having a diameter of 12.8 mm and a height of 4 mm.

The green compacts were introduced into a vacuum furnace and heated there under a pressure of $8\times10^{-6}$ torr at a rate of temperature elevation of 14° C./minute. When the temperature had reached 600° C., the rate of temperature elevation was increased to 61° C./minute until the temperature reached 850° C. and this temperature was maintained for 30 minutes. In the course of this temperature elevation, fusion apparently took place at 814° C., 816° C. and 817° C. as indicated by [1], [2]and [3]in the accompanying drawing for the nickel:titanium mixing ratios of 49:51, 50:50 and 56:44, respectively. After cooling, the solidified body in the mold was taken out of the mold and examined by the X-ray diffractometry, electron microprobe analysis and other metallographic means to give a conclusion that the body was not a mere sintered body of the metal powders but an alloy of nickel and titnaium was formed.

These temperatures for fusion and alloying were by about 430° C. lower than the eutectic point of ca. 1240° C. of the corresponding alloys of nickel and titanium as is shown in the accompanying drawing which illustrates the phase diagram of the nickel-titanium system.

For comparison, the above described experimental procedure was repeated with a different schedule of temperature elevation. Thus, the initial rate of temperature elevation of 14° C./minute was maintained without increasing at the intermediate stage of heating until the temperature had reached 950° C. and this temperature was maintained for about 1 hour. In this case, no fusion and alloying took place in the green compacts.

What is claimed is:

1. A method for the preparation of a shaped body of an alloy of nickel and titanium in an alloying ratio in the range from 49:51 to 56:44 by the atomic ratio which comprises the successive steps of:

(a) mixing powders of nickel and titanium in an atomic ratio in the range from 49:51 to 56:44 to give a powdery mixture;

(b) molding the powdery mixture by compression into a green compact;

(c) heating the green compact in an atmosphere of vacuum under a pressure not exceeding $1\times10^{-5}$ torr at a rate of temperature elevation in the range from 5° to 30° C. per minute from about 200° C. up to a temperature in the range from 580° to 650° C.; and (d) heating the green compact after the step (c) in an atmosphere of vacuum under a pressure not exceeding $1\times10^{-5}$ torr at a rate of temperature elevation of at least 40° C. per minute from a temperature in the range from 580° to 650° C. up to a temperature in the range from 815° to 900° C.

2. The method for the preparation of a shaped body of an alloy of nickel and titanium according to claim 1 which further comprises:

(e) keeping the green compact after the step (d) at a temperature in the range from 830° to 900° C. for a length of time in the range from 10 minutes to 2 hours.

3. The method for the preparation of a shaped body of an alloy of nickel and titanium according to claim 1 wherein the powder of nickel has an average particle diameter not exceeding 2.2 μm.

4. The method for the preparation of a shaped body of an alloy of nickel and titanium according to claim 1 wherein the powder of titanium has an average particle diameter not exceeding 55 μm.

* * * * *